US005645489A

United States Patent [19]

Laiche et al.

[11] Patent Number: 5,645,489

[45] Date of Patent: Jul. 8, 1997

[54] HOBBY HORSE WITH PROTECTIVE SHEATH

[75] Inventors: Eric Laiche, Houston; Chris Wheat, Greenwood; Roy L. Ruggles, Columbus, all of Miss.

[73] Assignee: Roadmaster Corporation, Olney, Ill.

[21] Appl. No.: 482,301

[22] Filed: Jun. 7, 1995

[51] Int. Cl.[6] ..... A63G 15/00

[52] U.S. Cl. ..... 472/103; 472/105; 472/100

[58] Field of Search ..... 472/95, 100, 103, 472/104, 105, 118; 74/18.12; 267/33; 188/322.12; 277/212 FB

[56] References Cited

U.S. PATENT DOCUMENTS

| | | | |
|---|---|---|---|
| D. 165,491 | 12/1951 | Spangler . | |
| D. 167,464 | 8/1952 | Koller . | |
| D. 180,620 | 7/1957 | Salter, Jr. et al. . | |
| D. 190,431 | 5/1961 | Peltier . | |
| D. 344,297 | 2/1994 | Amburgey et al. . | |
| 362,941 | 5/1887 | Crandall et al. . | |
| 366,571 | 7/1887 | Crandall . | |
| 385,792 | 7/1888 | Crandall . | |
| 2,625,395 | 1/1953 | Spangler . | |
| 2,756,051 | 7/1956 | Shone . | |
| 2,806,698 | 9/1957 | Thoeming | 472/105 |
| 2,915,312 | 12/1959 | Barthel . | |
| 2,919,132 | 12/1959 | Canady . | |
| 4,114,460 | 9/1978 | Oto | 188/322.12 |
| 5,197,925 | 3/1993 | Cunard | 472/118 |
| 5,328,410 | 7/1994 | Amburgey et al. . | |

*Primary Examiner*—Kien T. Nguyen

*Attorney, Agent, or Firm*—Brinks Hofer Gilson & Lione

[57] ABSTRACT

An improved child amusement device, such as a hobby horse, with flexible extendable sheaths protectively and aesthetically covering the supporting elastic members, such as coil springs and associated attachment hardware.

9 Claims, 4 Drawing Sheets

HOBBY HORSE WITH PROTECTIVE SHEATH

BACKGROUND OF THE INVENTION

The present invention relates to an improved version of a child's amusement device commonly known as a hobby horse. In a conventional hobby horse, a toy horse (e.g., plastic, fiberglass or similar construction) is suspended by elastic members between a plurality of upright support posts. The horse typically has an integrally molded saddle and is capable of supporting the weight of a child. The elastic members suspending the horse allow the horse a range of movement which allows it to tilt fore-aft and side-to-side. The child mounts the horse and applies her weight to it to initiate and control the horse's movement. Other vehicles, animals or fanciful structures may alternatively be simulated.

Coiled metal springs are often used as elastic members to suspend the horse. In an untensioned spring, the metal coils are immediately adjacent to one another. When a rider's weight is applied to the horse the metal springs extend and retract to allow for the horse's motion. When a spring is extended, adjacent coils of the spring become spaced a distance apart. A child's skin or finger may stray into the space between adjacent coils and become pinched when the spring retracts to its unloaded position. The pinch is painful and may cause injury.

Prior art protection means include covering the spring with a non-extendable plastic sheath. Although generally effective, improved protection would also be desirable. For example, the non-extendable sheath's length is equal to that of the unextended spring. Therefore, only the unextended spring is completely covered by the non-extendable sheath. The ends of the springs which are fastened to the horse, the fastening components, and the supports remain exposed. Moreover, during operation of the hobby horse the extension spring extends beyond the length of the non-extendable sheath. Portions of the spring extending beyond the non-extendable sheath are therefore open and exposed while the child is riding the hobby horse.

It is also desirable to provide a protective sheath which is neat and attractive. Present protective devices generally detract from the appearance of the hobby horse, and certainly do not enhance its appearance.

Prior art non-extendable sheathes may also lack the durability to last the life of the hobby horse. Because non-extendable sheathes are unable to expand and move with the extension spring, they interfere with the extension of the metal spring. Portions of the sheath which come in repeated contact with the metal spring thus become worn. After repeated use, the non-extendable sheath eventually wears through and is eventually torn off the spring, where it can provide no protection to a rider.

Another object of the invention is to provide a safer riding toy without restricting the range of riding motion. Some earlier attempts to provide a safer riding toy compromised the rideability of the toy because the protection means restricted the riding horse's range of movement. The use of elastic members consisting of materials other than the traditional metal springs, such as rubber bands or other mechanical support arrangements, often compromised the rideability and durability of the horse. Rubber bands tend to wear out as the rubber bands are repeatedly stretched and other mechanical arrangements constrict the range of the rocking horse's motion.

Therefore, there is a desire for a hobby horse with durable, protected springs. There is also a desire for a hobby horse having enhanced aesthetics.

SUMMARY OF THE INVENTION

The present invention provides a safer, more attractive amusement device for children. The preferred embodiment of the present invention comprises a riding device, such as (but not limited to) a hobby horse, with a base having at least one support structure. In a particularly preferred embodiment, a plastic riding horse is suspended by the support post by at least one elastic member which is covered by a flexible, extendable sheath. The elastic members are connected between the riding horse and the support posts such that the riding horse is suspended from the support structure by the elastic members. A flexible, extendable sheath is fitted over one or more elastic member, the fastening (attachment) hardware and a portion of an adjacent support structure. Completely covering the elastic member with the extendable sheath prevents a child from coming in contact with the member or any adjacent fastening or support components, eliminating the risk of harm. It further provides a clean, substantially uncluttered appearance to the user by enclosing the various functional elements of the elastic support system.

The riding device includes attachments for the supporting flexible members. These may comprise eye-bolts or other structures for cooperating with a first end of each elastic member. The attachments may be proximate to or integral with the body of the riding device, or may be associated with a body support structure (such as a transverse rod or tube). In preferred embodiments, attachments are also provided to secure a first end of the protective sheath proximate the riding device (or a cooperating support structure, if used).

The flexible, extendable sheath preferably has a ribbed construction which is capable of extending in the direction along its length. The ribbed-like construction gives the sheath properties which allow it to extend and collapse with the elastic member it covers. The flexibility and expendability of the sheath allow it to move with the elastic member thereby also improving the durability of the sheath. In certain embodiments the sheath may have accordion-like pleating. In others, the flexible extendable sheath may include regions which are extendable and/or flexible, and other regions which are not. In other embodiments, the extendable sheath may be substantially smooth but made of a flexible material. In still other less preferred embodiments, the extendable sheath may not stretch significantly in length, but is configured to translationally slide over the various support elements while continuously covering the elastic member as the elastic member is stretched and relaxed.

In one preferred embodiment the support structure comprises tubular supports (e.g., bent steel tubing or plastic tubing). In other embodiments, blow-molded plastic panels or elements may comprise the base. In all cases, the base includes attachments adapted to receive and support one end of the elastic members. In particular embodiments, the base further includes attachments for securing a second end of the flexible sheath to the base.

The preferred embodiment of the invention provides an eye-bolt fastener to allow connection of a spring to a support post or frame. Because the improved extendable sheath covers the fastener means, the most preferred embodiment provides a protective cap which fits over the eye-bolt. A portion of the protective cap is left open so that the eye-bolt is accessible for the spring to be attached. The crown of the protective cap, which is preferably a partial dome shape, provides a shield surface which reduces the binding of the extendable sheath against eye-bolt. The extendable sheath is thus protected from wearing against the eye-bolt of the fastening assembly.

The present invention also provides protection to the rider while maintaining the desired aesthetic appeal of the traditional metal spring hobby horses. The preferred extendable protective sheath includes an elongatable, ribbed construction which maintains the familiar notion of traditional spring hobby horses in which the shape of the spring suggests the springing action which may be achieved. The extendable sheath's construction allows an integrated fit and smooth transition between the spring and support posts of the preferred hobby horse. Components such as stirrups can also be integrated into the design of the protected springs.

DETAILED DESCRIPTION OF THE PREFERRED EMBODIMENT

Figure 1A:
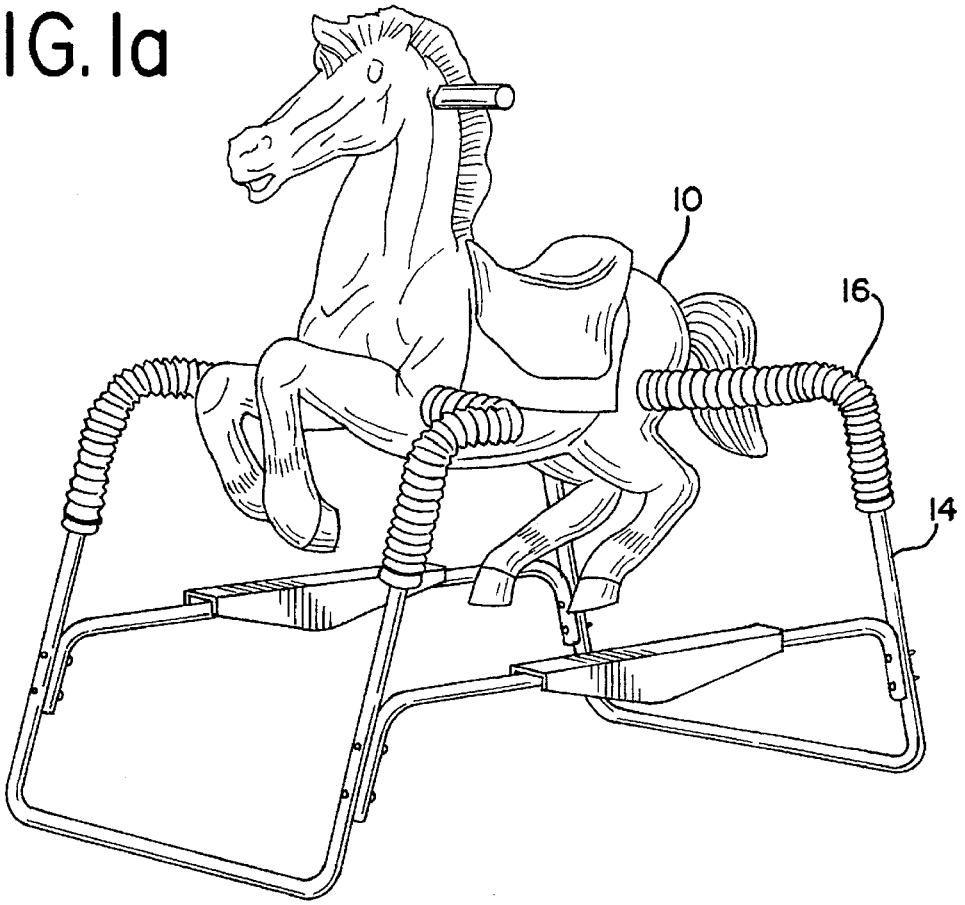
FIGS. 1*a–b* are perspective views of a preferred embodiment of the toy riding apparatus of the present invention.
Figure 1B:
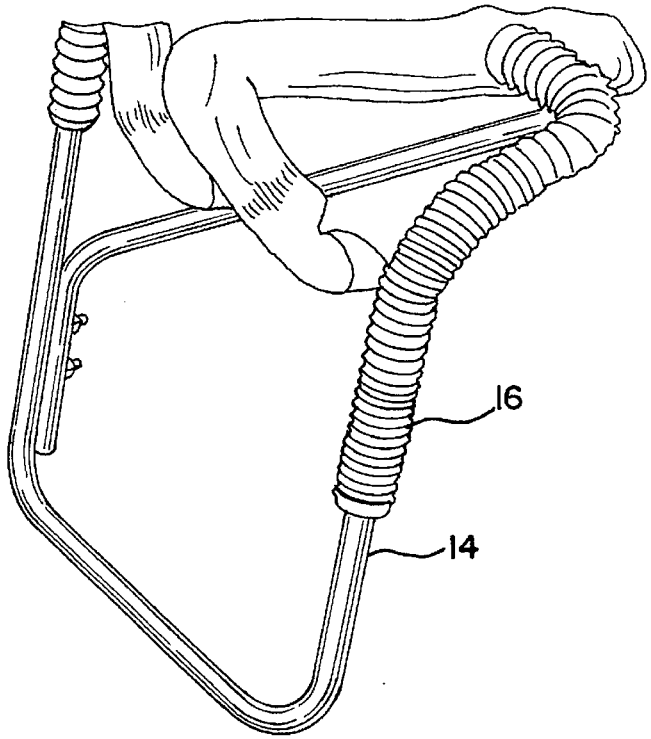

As seen in FIG. 1 (in conjunction with certain hidden details illustrated by other Figures), the preferred embodiment of the present invention looks much like a traditional hobby horse. Preferably, a plastic horse 10 is supported by a plurality of extension springs 12 which are attached to structural support or post 14. The springs 12 are attached to attachments which are functionally cooperative with the riding device 10. These may comprise eye-bolts or other structures, as known in the art. The spring attachments may be integral to the body of the riding device, or may be functionally coupled thereto. In the embodiment illustrated in FIGS. 1 and 6, the spring attachments 40 are at the ends of a longitudinal support member 61, which in turn is secured to the body of the riding device 10. Preferably, the springs 12 are encased in a flexible, extendable sheath 16 to protect the rider from the metal coils of the spring 12. As the horse is ridden, the protective sheath 16 extends and flexes with the spring 12 supporting the horse 10. It will be understood that other forms of riding devices may be used, such as (but not limited to) other animals, vehicles, chairs, or fanciful structures.

Preferably, the elastic member is an extension spring 12, as is well known in the art. It will be understood that other elastic members may alternatively be used, without departing from the scope of the present invention. For example, elastomeric supports of various types may be adapted for use, alone or in conjunction with coil springs. Energy absorbers may also be incorporated if desired. Other forms of elastic support (e.g., gas springs) may also be used.

Figure 2:
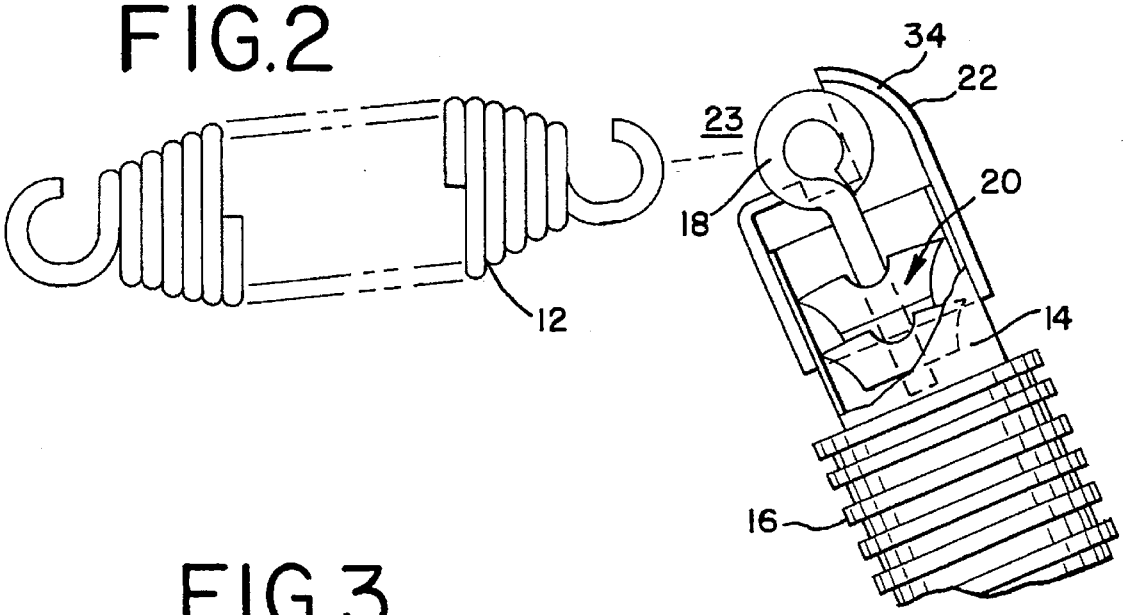
FIG. 2 is a partially cut-away side view showing a preferred attachment of the extension spring to a tubular support post.
Figure 4A:
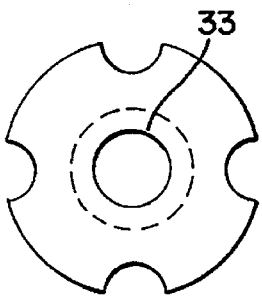
FIGS. 4*a–b* are top and side views of the tube connector shown in FIG. 2.

As seen in FIG. 2, in a particularly preferred embodiment the extension spring 12 may be attached to a tubular support post 14 with a fastener comprising a closed eye-bolt 18, a tube connector 20 and an eye-bolt cap 22. In the most preferred embodiment, a standard one inch tube connector 20 for a 16–18 tube gauge, as well known in the art, is secured inside a one inch support post 14. Most preferably, the tube connector 20 comprises two flanges 31, 32 connected by a central threaded portion 33, as shown in FIGS. 4*a,b*. A quarter inch closed eye-bolt 18 is threaded into the center threads 33 of the tube connector 20. The eye-bolt cap 22 is then fitted over the end of the support post 14 and the eye-bolt 18.

As seen in FIG. 2, the crown 34 of the eye-bolt cap 22 covers enough of the eye-bolt 18 so that the sheath 16 is not in contact with the eye-bolt. Preferably, the eye-bolt cap 22 leaves a portion of the eye-bolt 18 accessible so that the spring 12 can be attached to the eye-bolt 18 through the opening in the cap 23.

The flexible, extendable protective sheath 16 is most preferably made of polypropylene with an olefin for impact modification and UV resistance. The extendable sheath preferably has a ribbed construction allowing it to extend beyond its original length. The extendable sheath may also be of an accordion-like construction. In the most preferred embodiment, the sheath 16 has an inside diameter of 1.25 inches to cover a hobby horse with a 1 inch support post 14. Preferably, for a 0.125 inch, hard drawn extension spring with 33 coils, an overall length of 5,225 inches unextended and 8.5 inches under a load of 50 pounds, a sheath of about 18 inches in length is required to cover the spring, the fastener assembly, and a portion of the adjacent support posts. The ends of the extendable sheath may optionally be secured to the structural support by a sheath fastener such as simple screw, a strap or a similar type of band clamp. A riding stirrup for a user's foot can also be provided.

Figure 3:
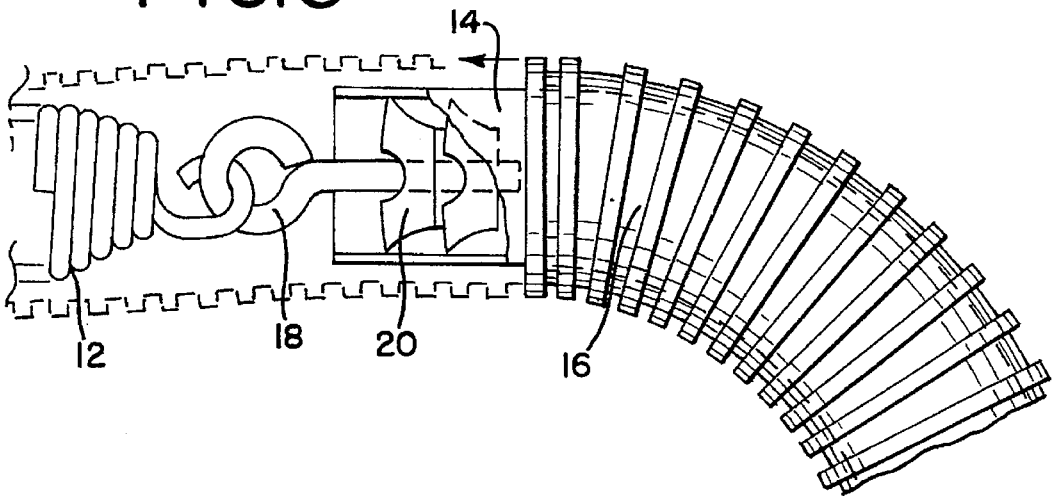
FIG. 3 is a partially cut-away side view of an alternative embodiment showing a coaxial spring attachment.

In an alternate embodiment shown in FIG. 3, a coaxial connection between the extendable sheath 16, spring 12 and the support post 14 is also within the scope of the present invention. The ends of the support posts may be radiused at an angle to facilitate the axial connection of the spring 12 to the support post 14. The support post 14 is thus angled away from an upward, vertical orientation, to a generally horizontal orientation. The tube connector 20 and eye-bolt 18 of the preferred embodiment of the invention may be used as a fastener assembly. The eye-bolt cap is not needed. When the spring 12 is connected to the fastener assembly, the spring 12 and the end of the angled support post are substantially aligned, although as used herein the term coaxial does not require the elements to be linear. The axial connection between the spring 12 and the angled support allows the sheath 16 to be fitted over the support 14 and the spring 12 in a direction along so that the sheath 16 is able to extend along with the spring. The axial connection, rather than the eye-bolt cap, reduces binding of the protective sheath where the spring is connected to the support post, improving performance and increasing the durability of the protective sheath. The axial connection also provides a smooth transition between the support post and the spring, maintaining an integrated, aesthetic appearance.

Figure 4B:
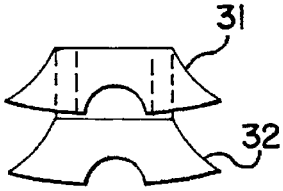

FIGS. 4*a* and 4*b* illustrate preferred embodiments of tube or ram connectors 20 which may be used in conjunction with the present invention. It should be understood, however, that alternative structures or techniques may be used for attaching the elastic members to the support frame and/or the riding device. By way of example, integral connectors may be formed in either or both of the support frame or riding device.

Figure 5A:
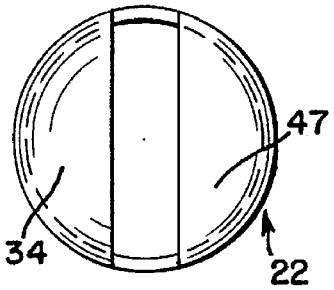
FIGS. 5*a–c* are top, side and front views of the eye-bolt cap shown in FIG. 2.
Figure 5B:
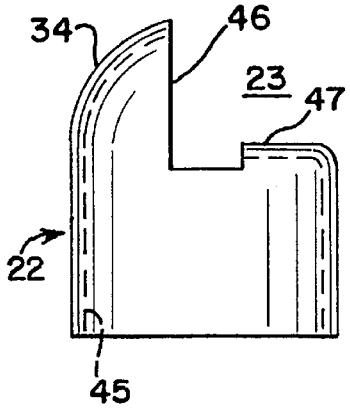
Figure 5C:
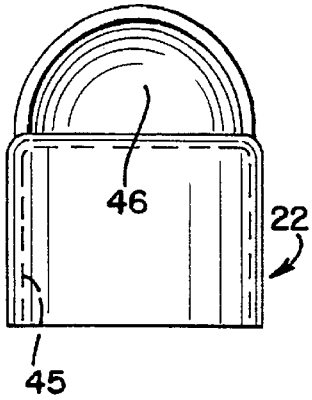

FIGS. 5*a*, 5*b* and 5*c* illustrate a preferred eye-bolt cap 22. The cap includes a first end which is adapted to cooperate with the support post 14, as shown in FIG. 2. For example, cylindrical recess 45 is provided. Recess 45 is preferably dimensioned for a secure frictional engagement on the end of support post 14. Adhesives or mechanical fasteners may also be used if desired.

The eye-bolt cap 22 has a second end which is adapted to at least partially cover the eye of eye-bolt 18, while still allowing sufficient access to the eye to allow attachment of spring 12. As shown, the second end of cap 22 may include a crown 34 which preferably describes a partial spherical surface. It should be understood that by the term spherical surface applicants intend to include generally smooth, curved surfaces which may not be continuous or geometrically spherical. This crown 34 extends sufficiently over the eye of eye-bolt 18 to provide a guide surface for the extendable sheath 16 while preventing direct contact between the sheath and the eye-bolt 18 and/or cooperating portions of spring 12. An aperture 46 is provided so that at least a portion of the eye of eye-bolt 18 is exposed when the sheath 16 is retracted. Finally, a ledge 47 is shown generally opposite the crown 34. Ledge 47 provides a further closure to encase the end of support post 14 and related elements securing eye-bolt 18, while still permitting access to the eye of eye-bolt 18. In preferred embodiments, ledge 47 may be dimensioned to extend proximate the shank portion of eye-bolt 18, providing maximum closure and also cooperating with the eye portion of eye-bolt 18 to help secure cap 22 on the end of support post 14.

Figure 6:
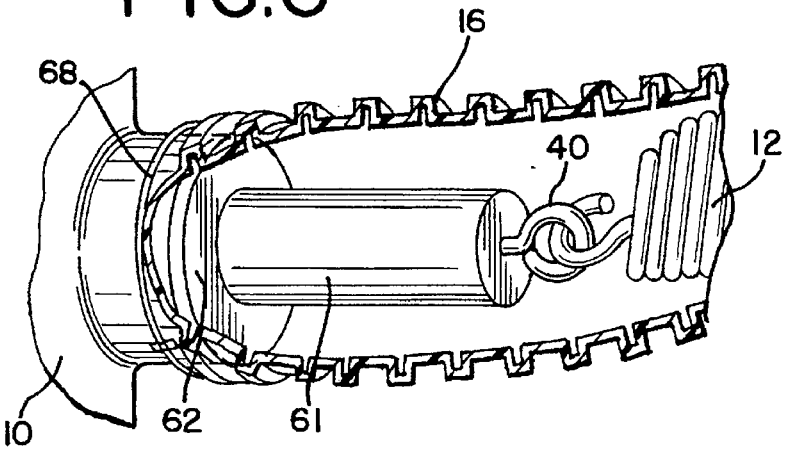
FIG. 6 is a partially cut-away view showing attachment of a flexible sheath to a riding device.

FIG. 6 illustrates one embodiment of an attachment between a riding device 10 and a flexible spring or other elastic element 12. In particular, a support member 61 is shown cooperating with the riding device 10. Support member 61 may comprise, by way of example, a rod, dowel or tube cooperating with the body of the riding device. An eye-bolt is illustrated cooperating with a hook on the end of spring 12. It should be understood that any attachment technique may similarly be used. Further, it should be understood that the use of a support device 61 is optional, and spring 12 may instead be secured directly to the body of riding device 10, or any attachment means cooperating therewith.

FIG. 6 further illustrates a flexible sheath 16 preferably secured to the body of riding device 10. In particular, a collar 62 is provided, having an outer diameter dimensioned to cooperate with the inner surface of a first end of flexible sheath 16, such as the inner surface of a circumferential rib on the sheath. A cable tie 68 or other securing device may be used to secure the sheath to the collar, preferably in conjunction with a recess to receive the tie.

Figure 7A:
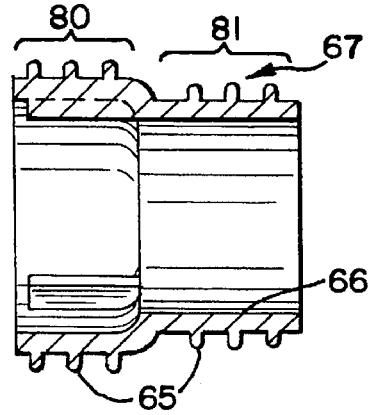
FIGS. 7*a–b* are sectional and side views of a preferred attachment.
Figure 7B:
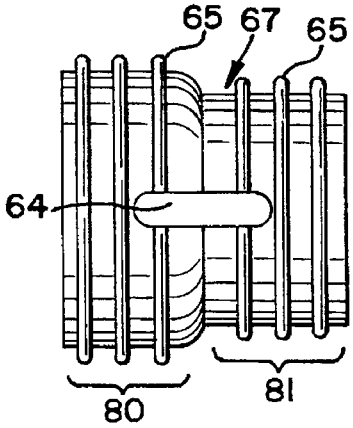

A preferred adapter collar is shown in partial cut-away in FIG. 7*a* and in side view in 7*b*. Collar 67 may preferably include a cylindrical bore or other portion adapted to cooperate with a complimentary portion of the riding device and/or support member. For example, bore 66 is dimensioned to snugly engage a support dowel. Preferably a screw or other means (e.g. adhesive, mechanical interference, etc.) may be used to secure the adapter 67 proximate the riding device, such as through slot 64. The flexible sheath is then attached to an extended portion of the adapter 67. For example, in the preferred embodiment illustrated the outer surface of the adapter is provided with one or more raised ribs or collars 65, dimensioned to cooperate with the inner surface of a first end of flexible sheath 16, such as the inner surface of a circumferential rib on the sheath.

The particularly preferred adapter illustrated may be used with either of two differing diameters of flexible sheath. The adapter 67 includes a first end 80 dimensioned to cooperate with a first (larger) sheath diameter, and a second end 81 dimensioned to cooperate with a second (smaller) sheath diameter. Generally the larger diameter end is placed against the riding device when the adapter is secured thereto, although either end may be extended if a larger diameter sheath is used. When a smaller diameter sheath is used, it will engage only portion 81 of the adapter. Although the portion 80 is then exposed, its ribbed appearance continues the aesthetic of the ribbed sheath, and provides a desirable appearance. When a larger diameter sheath is used, the entire adapter will generally be covered, with the ribs 65 on the end 80 engaging the sheath.

It should be understood that other techniques may similarly be used for securing the first end of the sheath 16 to the riding device or support post. For example, adhesives or other mechanical fasteners (e.g., screws or mechanical collars) may be utilized. In other embodiments, a collar may be provided having an inner diameter selected to cooperate with the outer surface of flexible sheath 16.

Figure 8A:
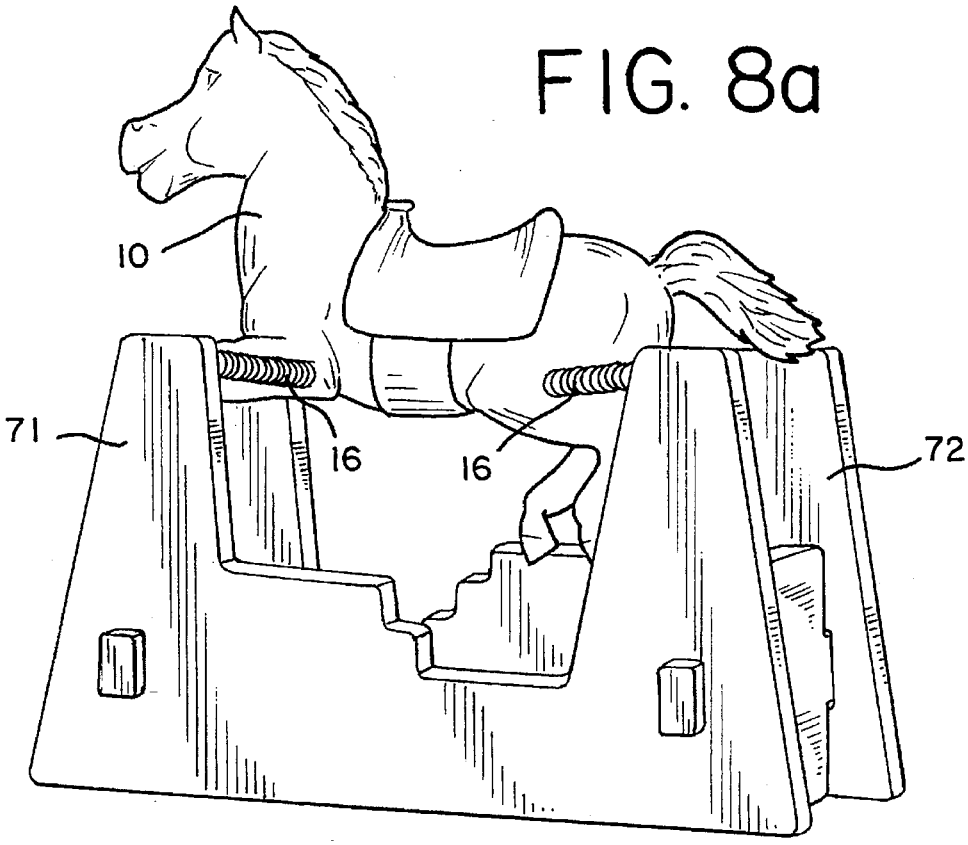
FIGS. 8*a–b* are side perspective and rear views of an alternate embodiment of the invention.
Figure 8B:
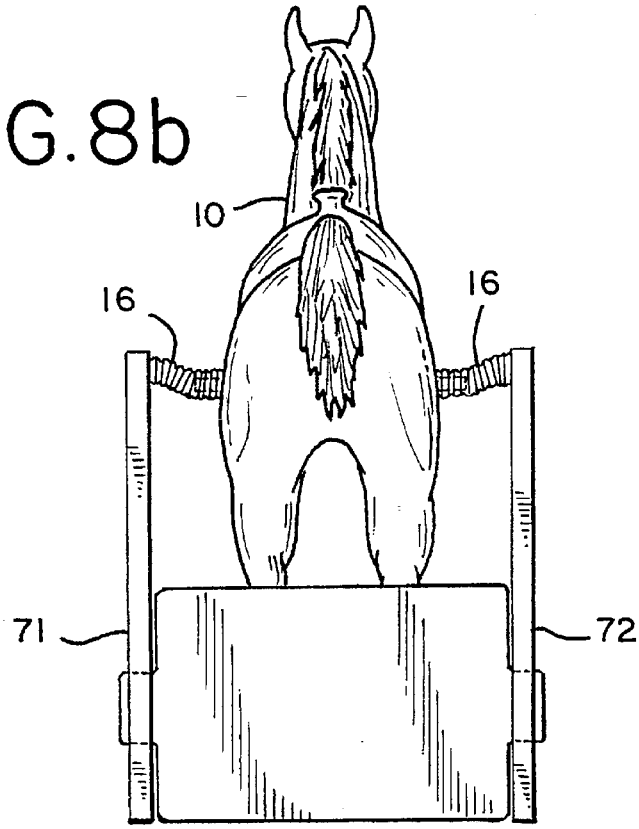

FIGS. 8*a* and 8*b* illustrate another embodiment of a child's amusement device incorporating the present invention. In particular, a support frame is shown comprising blow-molded panels or members 71, 72. These members may have any desired configuration, so long as appropriate attachment points are provided for the elastic members. In this embodiment, the second end of the flexible sheath 16 is preferably secured to the blow-molded support panels 71, 72. For example, recesses or collars as discussed above may be integrally formed by the blow-molding process, or appropriate structures may be otherwise provided to receive and secure the flexible sheath 16.

Other embodiments of the present invention are possible. The extendable sheaths may be other material such as nylon, resilient rubber or other material suitable for fabricating a flexible, extendable covering material. Other fastening assemblies utilizing different types of hooks, clamps, threaded caps or friction fitting device, as well known in the art, may also be employed.

Of course, it should be understood that a wide range of changes and modifications can be made to the preferred embodiment described above. It is therefore intended that the foregoing detailed description be regarded as illustrative rather than limiting and that it be understood that it is the following claims, including all equivalents, which are intended to define the scope of this invention.

What is claimed is:

1. A riding device, comprising:

a rider support device;

one or more elastic members, the elastic members connected to the rider support device;

one or more extendable, flexible sheaths, the extendable sheath covering one or more corresponding elastic members;

a structural support;

a fastener assembly for connecting the elastic member to the structural support, where the extendable sheath covers the fastener; and a protective cap fit over the fastener which leaves a portion of the fastener accessible for connecting the elastic member.

2. The riding device of claim 1, the protective cap comprising a first end adapted to engage a portion of the structural support, and a second end for partially covering the fastener, said second end comprising a partial domed surface having an aperture therein to permit access to the fastener.

3. The riding device of claim 2, where the fastener assembly provides an axial connection between the elastic member and the support post.

4. The riding device of claim 1 wherein the structural support comprises a blow-molded base.

5. The riding device of claim 1 wherein the fastener comprises an eye-bolt.

6. A child amusement device, comprising:

a rider support device;

a support post;

a plurality of springs, each of the springs connected between the rider support device and a cooperative support post such that the rider support device is suspended from the support post by the springs;

a tube connector secured within the support post; an eye-bolt secured to the tube connector from which the spring can be attached;

a protective cap fit over the eye-bolt leaving a portion of the eye-bolt accessible; and a plurality of extendable sheaths, each of the extendable sheaths covering one of the springs.

7. A riding device, comprising:

a rider support device;

one or more elastic members, the elastic members connected to the rider support device;

one or more extendable, flexible sheaths, the extendable sheath covering one or more corresponding elastic members;

a structural support comprising a radiused support post, which is angled toward the riding device;

a fastener assembly for connecting the elastic member to the radiused support post, where the extendable sheath covers the fastener; and a protective cap fit over the fastener which leaves a portion of the fastener accessible.

8. The riding device of claim 7 wherein the structural support further comprises a blow-molded base.

9. The riding device of claim 7 wherein the fastener comprises an eye-bolt.

* * * * *